United States Patent [19]

Sieber et al.

[11] Patent Number: 4,896,444

[45] Date of Patent: Jan. 30, 1990

[54] EXCAVATION BUCKET

[76] Inventors: Karl G. Sieber, 8627 Beverly La., Dublin, Calif. 94568; Kurt G. Sieber, 720 Terrace View Dr., Greensburg, Pa. 15601

[21] Appl. No.: 226,531

[22] Filed: Jul. 28, 1988

Related U.S. Application Data

[60] Continuation of Ser. No. 96,065, Sep. 14, 1987, abandoned, which is a division of Ser. No. 740,811, Jun. 3, 1985, Pat. No. 4,719,711.

[51] Int. Cl.[4] ..... E02F 3/40

[52] U.S. Cl. ..... 37/118 R; 37/141 R; 414/722

[58] Field of Search ..... 37/103, 118 R, 141 R, 37/142 R; 414/694, 722

[56] References Cited

U.S. PATENT DOCUMENTS

| | | | |
|---|---|---|---|
| 2,972,425 | 2/1961 | Anderson et al. | 414/694 |
| 3,531,161 | 9/1970 | Conn | 37/103 X |
| 3,958,347 | 5/1976 | Heitman | 37/118 R X |
| 4,037,337 | 7/1977 | Hemphill | 37/141 R |
| 4,314,789 | 2/1982 | Luigi | 414/694 |
| 4,321,762 | 3/1982 | Hemphill | 37/141 R |
| 4,476,641 | 10/1984 | Ballinger | 37/118 R |
| 4,719,711 | 1/1988 | Sieber et al. | 37/118 R |

*Primary Examiner*—David A. Wiecking
*Assistant Examiner*—Moshe I. Cohen
*Attorney, Agent, or Firm*—Nils H. Ljungman

[57] ABSTRACT

An excavation bucket having a closed top and an open front and comprising two opposed sidewalls each with a flat and an outwardly extending flanged portion, which bucket digs an excavation which has a combination of a vertical wall area with an adjacent and contiguous sloped wall area. Teeth are mounted outwardly from the flanged portions of the sidewalls producing a terracing effect in the sloped sidewall area of the excavation.

7 Claims, 2 Drawing Sheets

EXCAVATION BUCKET

This application is a continuation of U.S. application Ser. No. 096,065, filed on Sept. 14, 1987, now abandoned, which is also a divisional application of U.S. application Ser. No. 740,811, filed on June 3, 1985, now U.S. Pat. No. 4,719,711.

BACKGROUND OF THE INVENTION

This invention relates generally to an excavation bucket for optimizing the cutting action thereby easily and quickly digging a trench or other excavation, such as a canal or drain. More particularly, a bucket for digging an excavation has both vertical and sloped sidewall areas with a cutting edge.

Digging deep and wide trenches usually required for footer construction in erecting buildings or for laying of large pipelines, or for irrigation ditches necessitates that several channel preparation passes be made. Excavations for small canals or drains or ditches for small pipelines may require only a single channel preparation pass be made. These passes or pass is generally made with an excavating bucket attached to a prime mover referred to as an excavator or backhoe or to similar equipment used in digging these trenches or excavations.

Some existing excavation bucket designs comprise vertical sidewalls with a lower cutting edge which cut the channel with vertical sides and a flat bottom resembling a retangular configuration. For safety standards and regulations, the channel dug by these designs must be reworked to give sloped sidewalls to eliminate the danger or likelihood of these vertical sidewalls from caving in, which could prove to be extremely hazardous and even fatal to a workman standing in these trenches, notwithstanding the extra time involved in redigging the trench.

Other existing excavation bucket designs provide for digging excavations with sloped sidewalls; however, they do not have the ability to dig the conventional vertical sidewall trenches which may be required in certain excavation applications. Also, the sloped walls of the excavation are usually substantially smooth thereby allowing erosion to occur.

Some examples of the sloped bucket design along with their operation are disclosed in U.S. Pat. Nos. 1,208,835; 2,972,425; 3,792,539; and 4,314,789. The bucket design exemplified in U.S. Pat. No. 3,792,539 issuing to Clark illustrates detachable wings mounted on opposite vertical side panels for digging excavations with either sloped sidewalls or conventional vertical sidewalls.

A drawback to the sloped sidewall bucket designs known in the art is that either vertical walls or sloped walls are formed in the excavation, and not both. In order for the Clark patent to perform one of these two functions, it is necessary to attach or detach the wings, which operation involves downtime resulting in decreased productivity. Some other drawbacks to all the sloped bucket designs of the known art is an increase in the resistance of these buckets in their movement through the earth due to the angle of the sidewalls and the bottom of the bucket, and also the interference in the maneuverability of these buckets which is due in part to their high center of gravity, which become particularly important in change over operations entailing the attachment and/or removal of these sloped buckets from the prime mover.

Another drawback to all the present sloped bucket designs particularly comes into play when pipe is laid in the sloped trenches in that the compaction force of the fill material on the pipe causes a wall of the pipe to cave inwardly producing an ovality condition for the pipe, which condition may be unacceptable according to safety standards.

SUMMARY OF THE PRESENT INVENTION

It is therefore an object of the present invention to provide a design for an excavation bucket that will optimize the cutting action of the bucket into and through the earth to more quickly and efficiently dig an excavation with a combination of the conventional vertical sidewalls and sloped sidewalls, which design saves downtime and increases productivity. This combined vertical and sloped sidewall feature has particular application to but is not limited to the laying of pipe in that the vertical walls of the excavation prevent the fill material from lateral movement in this area of the trench thereby decreasing the compaction force on the pipe and distortion thereof, while still providing the safety feature of sloped sidewalls.

It is a further object of the present invention to provide an excavation bucket having sidewall panels which have a vertical portion and an inclined portion with protruding teeth which portions both cooperate to provide a rectangular keyway area with a contiguous diverging flanged or sloping area, and which novel configuration decreases the resistance when moving into and through the earth and the risk of the excavated sidewalls caving in. The teeth along a cutting edge of the sloped portions of the panels form indentations in the sloped sidewalls of the excavation in a terracing effect which greatly lessens the possibility of the soil falling into the excavation and increases the strength of the sidewalls in the excavation.

More particularly, it is an object of the present invention to provide an excavation bucket for digging an excavation, comprising a body shell with an open front leading into a cavity in which excavated material enters and is carried. The shell comprises a strip curved along substantially 90° of an arc measured in side elevation and forming a backbone for the bucket. The strip has a lower forward end and an upper rearward end formed by the curved strip extending rearwardly and upwardly away from the lower forward end. A digging edge protrudes from the lower forward end. Two opposed side panels extend alongside the curved strip from the lower forward end to the upper rearward end. A top plate is secured to an inward edge of the side panel and the upper rearward end of the curved strip. Each side panel has a generally flat portion near the lower forward end of the curved strip which extends upwardly to the rearward end of the bucket and an inclined portion diverging outwardly from the flat portion near the vicinity of the upper rearward end of the bucket towards the open front of the body shell such that a first portion of the cavity of the body shell has a rectangular configuration and a second portion of the cavity of the shell communicates with and is contiguous to the first portion. The second portion of the cavity has a general V-shaped configuration sloping inwardly. A cutting means is provided on an outer edge of said two opposed side panels extending outwardly from the open front of the body shell for cooperation with the digging edge of the lower forward end of the curved strip for the digging of the excavation.

BRIEF DESCRIPTION OF THE DRAWINGS

These objects as well as other objects, features, and advantages of the present invention become more fully apparent from the following detailed description of the preferred embodiment, the appended claims, and the accompanying drawings in which:

DETAILED DESCRIPTION OF THE PREFERRED EMBODIMENT

Figure 1:
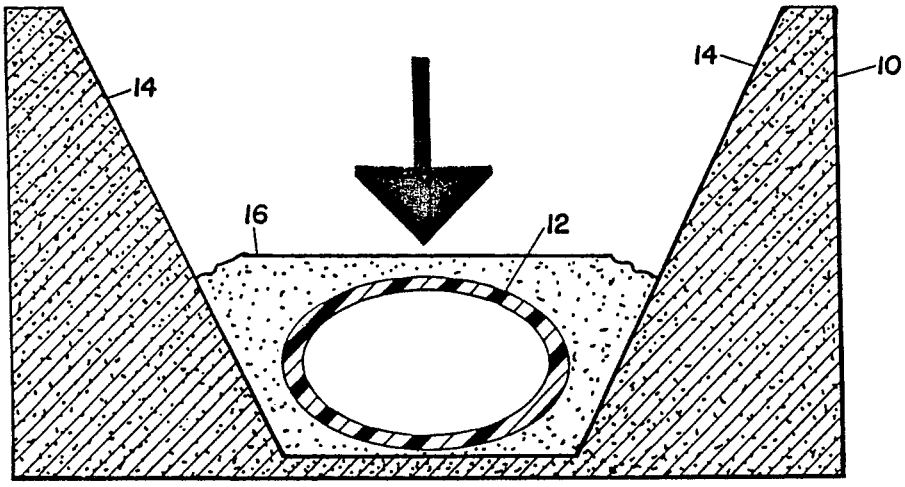
FIG. 1 is a schematic diagram illustrating the distortion effect the fill material has on a pipe in a trench dug by the bucket designs of the prior art.

Referring first to FIG. 1, there is shown an illustration of an excavation dug in the ground 10 by the present day sloped bucket designs and the effect the fill material 16 normally has on a pipe 12. As can be seen, the sloped sidewalls 14 provide no lateral support for the walls of the pipe 12 and the compaction force shown by the arrow of the fill material 16 pushing down on the pipe 12 gradually takes its toll on the pipe causing its walls to move in a lateral direction to assume an ovality condition, which naturally, is beyond acceptable specifications particularly those of utility companies, etc.

Figure 2:
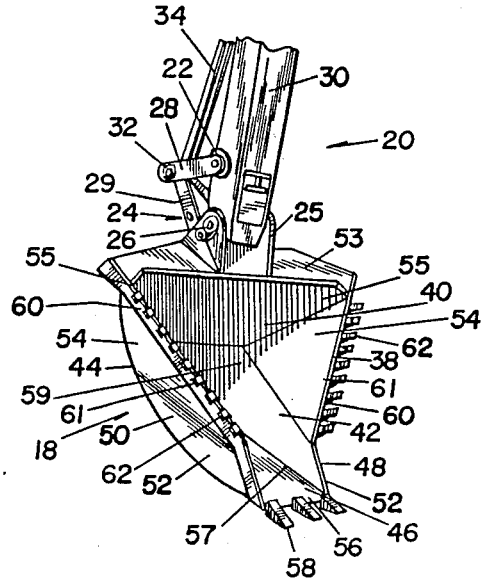
FIG. 2 is a perspective front elevation view of the present invention.
Figure 3:
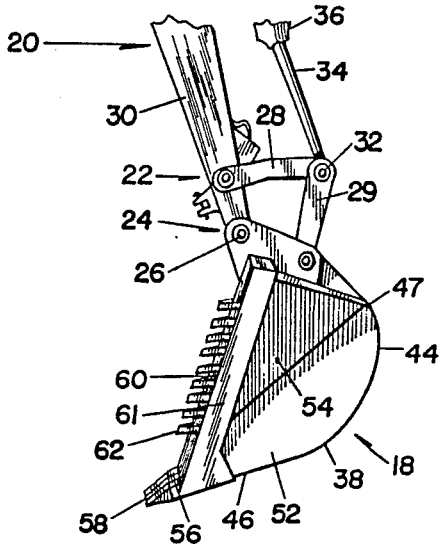
FIG. 3 is a side elevation of the present invention.
Figure 4:
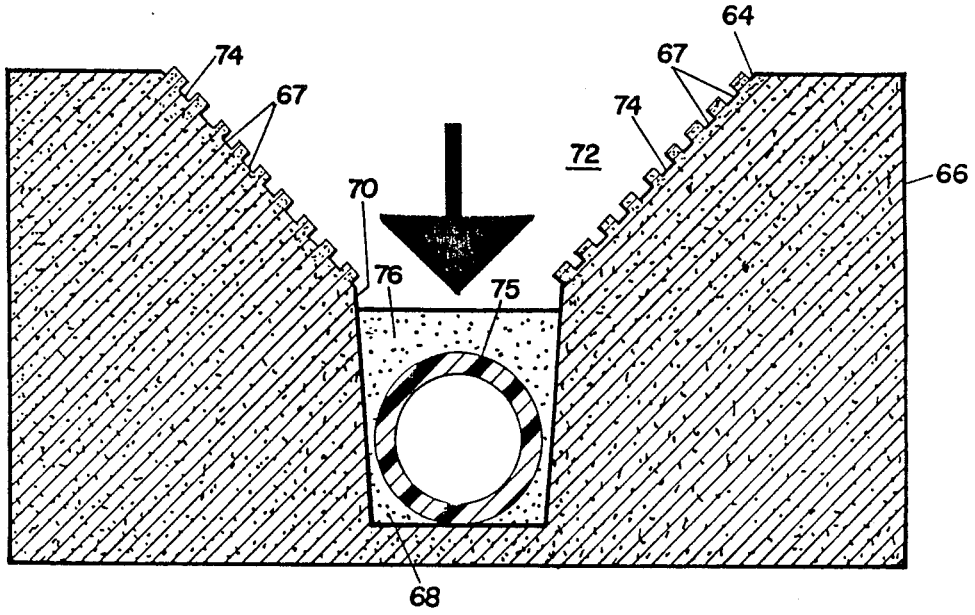
FIG. 4 is a schematic diagram illustrating that the fill material has little or no distortive effect on a pipe in a trench dug by the bucket design of the present invention.

The preferred embodiment is illustrated by way of example in FIGS. 2, 3, and 4. With specific reference to FIGS. 2 and 3, an excavation bucket 18 is pivotally mounted to the free end of an articulated boom 20 at spaced apart pivots 22 and 24 located on the top of bucket as particularly shown in FIG. 3. The design and operation of the articulated boom 20 and its connection or mounting on a prime mover may follow the teachings of any of the above-stated U.S. Patents, particularly Nos. 2,972,425 and 4,314,789 which are incorporated herein by reference.

The details of the prime mover equipment itself are not important to the present invention other than the specific design of articulated boom 20 at its free end at the pivotal connections 22 and 24 on an ear or bracket 25 of excavation bucket 18. Here it is seen in FIG. 3 that articulated boom 20 comprises an elongated arm or dipper stick 30 connected by a pivot pin 26 to bucket 18 to define the pivot 24 and a two-member linkage system 28, 29 where a first link member 28 in turn is connected by a pivot pin 32 to a second link member 29 and a rod 34 of a piston cylinder assembly, partially shown at 36. The first link member 28 attaches the back side of bucket 18 to the articulated boom 20.

This arrangement of articulated boom 20 connected to bracket 25 of excavation bucket 18 permits better control of the vertical and pivotal movements of the bucket in its digging operation, which operation is more fully described in the above incorporated patents. The connection of bucket 18 to articulated boom 20 at pivots 22 and 24 in addition to the bucket's improved balancing feature which is due to its unique design in providing a lower center of gravity makes the operation of attaching and/or detaching of bucket 18 from the prime a more simpler and efficient procedure.

The construction of bucket 18 is particularly shown in FIGS. 2 and 3 where it is seen that bucket 18 is an integral one piece construction. Several of the pieces or components are welded together as shown to form bucket 18. Bucket 18 may be of a high strength carbon steel. The bucket 18 comprises a body shell 38 with an open front 40 (FIG. 2) leading into a cavity 42 which carries the material removed from the trench. Body shell 18 comprises a strip 44 curved along substantially a 90° of an arc measured in the side view elevation of FIG. 3, which strip 44 forms a backbone for bucket 18. Strip 44 has a lower forward end 46 and an upper rearward end 47 formed by the curved strip 44 extending rearwardly and upwardly away from the lower forward end 46. A digging edge or lip 56 protrudes from the lower forward end 46 of strip 44. Two opposed side panels 48, 50 extend alongside the curved strip 44 from the lower forward end 46 to the upper rearward end 47. A top plate 53 is secured to an inward edge 55 of the side panels 48, 50 and the upper rearward end 47 of the curved strip 44. The two opposed side panels 48 and 50 are vertically disposed relative to strip 44 and top plate 53 with particular reference to FIG. 2. The two side panels 48 and 50 each have a generally flat portion 52, near the lower forward end 46 of the curved strip 44 extending upwardly to the rearward end 47 and an inclined portion 54 diverging outwardly from the flat portion 52 near the vicinity of the upper rearward end 47 of the bucket 18 towards the open front 40 of the body shell 38 such that a first portion 57 of the cavity 42 of the body shell 38 has a rectangular configuration and a second portion 59 of the cavity 42 communicates with and is contiguous to the first portion and has a general V-shaped configuration sloping of the cavity 42.

The two opposed side panels 48 and 50 abut and are welded to strip 44 and top member 48 to form cavity 42 of body shell, and side panels 48 and 50 can either be welded pieces or stamped sheets. Extending from lower section of strip 42 is a digging edge or lip 56 which comprises a plurality of teeth 58 of conventional configuration mounted conventionally on strip 44 according to well known practice.

Cutting means 60 are provided on an outer edge 61 of each of the inclined portions 54 of the two opposed side panels 48, 50 for cooperation with the digging edge 56 of the lower forward end 46 of the curved strip 44 for the digging of the excavation. The teeth 62 of cutting means 60 are made of high carbon abrasive steel, as are the teeth of lower digging edge 56, and are mounted in a conventional manner along outer edges 61 according to well known practice.

As shown in FIG. 3, teeth 58 of digging edge 56 are longer than teeth 62 in the diverging flange portions 54 of side panels 48 and 50, which will be more fully discussed in the operation of bucket 18.

As shown in FIG. 2, the front of body shell 38 of bucket 18 has a rectangular lower section and a sloping upper section contiguous to lower section. The upper sloping or diverging section is formed by the diverging flanged portion 54 of side panels 48, 50, which is generally in a V-shaped configuration and these lower and upper sections of bucket 18 form a similar configuration in the excavation. That is, upon one or several passes of the excavation process, a trench is dug having a vertical sidewall portion of a keyway formed by the rectangular lower section combined with a sloped sidewall portion formed by the upper V-shaped section of bucket 18 similar to the trench exemplified in FIG. 4.

For the best results in digging the safest excavation, bucket 18 is to be operated in a pivotal fashion where the teeth 58 on front digging edge 56 first enters the trench followed by the cutting action of teeth 62 on flanged portions 54 of the upper section of bucket 18 where the lowest to the uppermost teeth 62 on both side cutting edges 60 sequentially enter the excavation in a terracing or stepping fashion, which procedure produces a terracing effect in the sloped sidewalls of the excavation.

The configuration of the excavation 64 shown in FIG. 4 can be made with either one pass or several passes of bucket 18 through the earth 66 depending on the required overall dimension for the trench 64. Due to teeth 62 on cutting means 60, the sidewalls 74 are notched out along their sloped surfaces as schematically shown at 67. As alluded to, these indentations 67 catch the crumbling soil which may fall back down in the excavation 64 and these indentations 67 also strengthen the sidewalls thereby minimizing erosion.

The configuration of the excavation 64 shown in FIG. 4 where lower trench 68 is formed with the vertical sidewalls 70 and an upper trench 72 is formed with the sloped sidewalls 74 has particular application in the laying of pipes. The span between vertical sidewalls 70 can be made such as to be slightly greater in dimension than the diameter of pipe 75 so that as the fill material 76 settles in lower trench 68, the effective compaction force shown by the arrow is less, therefore, lateral movement of the wall of pipe 75 is less likely to occur, which little or no distortion of pipe 75. It is apparent that distortion of pipe 75 occurs if it is placed in the trench of the prior art as shown in FIG. 1 since more fill material is needed to cover the pipe, and therefore, the compaction force is greater as is the space around the pipe allowing the pipe to expand laterally.

The intersecting area of the vertical section 52 with the flanged portion 54 near the cutting edge 60 of each side panel 48, 50 forms an angle such as to create an optimum cutting edge where the total digging action of bucket 18 has very little resistence when moving through the earth when compared to the designs of the prior art.

While the present invention has been described in connection with the preferred embodiment thereof, it should be understood that there may be other embodiments which fall within the spirit and scope of the invention as defined by the following claims.

In accordance with the provisions of the patent statutes, we have explained the principle and operation of our invention and have illustrated and described what we consider to represent the best embodiment thereof.

We claim:

1. An excavating bucket for digging an excavation comprising a trench therein, said bucket comprising:

means for providing an excavation, said excavation having a bottom portion and two flared edges leading from said bottom portion;

said flared edges comprising a plurality of substantially planar sloping surfaces;

said means for providing an excavation comprising;

a first portion means for forming said bottom; and a second, outwardly flared V-shaped, portion means contiguous to said first portion means for forming said two flared edges;

said second, outwardly flared V-shaped, portion means having cutting edges, said cutting edges having a plurality of teeth comprising means for producing a plurality of notches on said substantially sloping surfaces of the flared edges of said excavation for producing indentations for catching at least crumbling soil on said notched flared edges of said excavation, with a substantial number of said notches having a substantially planar flat portion, with most of said flat portions being substantially parallel to said planar sloping surfaces of said flared edges.

2. The excavating bucket according to claim 1, wherein said second, outwardly flared V-shaped, portion means is disposed during excavation immediately above said first portion means and forms cavity means with said first portion means for receiving material being excavated.

3. The excavating bucket according to claim 1, wherein said bucket includes:

a strip curved along substantially 90 degrees of an arc measured in side elevation and forming a backbone for said bucket, said strip having a lower forward end, forming a lower forward portion in use of said first means, and an upper rearward end formed by said curved strip extending rearwardly and upwardly away from said lower forward end.

4. The excavating bucket according to claim 3, wherein said first portion means includes a digging edge protruding from its lower forward end.

5. The excavating bucket according to claim 4, including two opposed side panels means extending alongside said curved strip from its said lower forward end to its said upper rearward end.

6. The excavating bucket according to claim 5, including a top plate secured to an inward edge of said side panel means and said upper rearward end of said curved strip.

7. The excavating bucket according to claim 6, wherein said each side panel means has a generally flat portion near said lower forward end of said curved strip extending upwardly to said rearward end of said bucket.

* * * * *